United States Patent [19]

Fukui et al.

[11] Patent Number: 4,589,786

[45] Date of Patent: May 20, 1986

[54] IMPACT PRINTER HEAD CAPABLE OF PRINTING A DOT AT A DISTANCE NARROWER THAN A THICKNESS OF A PRINTER UNIT

[75] Inventors: Izumu Fukui; Takeshige Hamatsuki; Takeshi Yano; Eiichi Sato; Osamu Inui, all of Tokyo, Japan

[73] Assignee: NEC Corporation, Tokyo, Japan

[21] Appl. No.: 520,772

[22] Filed: Aug. 5, 1983

[30] Foreign Application Priority Data

| | | | |
|---|---|---|---|
| Aug. 5, 1982 | [JP] | Japan | 57-136723 |
| Jun. 10, 1983 | [JP] | Japan | 58-103809 |
| Jun. 17, 1983 | [JP] | Japan | 58-108685 |
| Jul. 29, 1983 | [JP] | Japan | 58-139038 |
| Jul. 29, 1983 | [JP] | Japan | 58-139039 |

[51] Int. Cl.[4] ..... B41J 3/12

[52] U.S. Cl. ..... 400/124; 101/93.05

[58] Field of Search ..... 400/124; 101/93.05; 310/328

[56] References Cited

U.S. PATENT DOCUMENTS

| | | | |
|---|---|---|---|
| 3,217,640 | 11/1965 | Bradshaw | 400/124 X |
| 3,900,094 | 8/1975 | Larsen et al. | 400/124 |
| 4,134,691 | 1/1979 | Matschke | 400/124 |
| 4,193,703 | 3/1980 | Sakmann | 400/124 |
| 4,408,907 | 10/1983 | Bernardis | 400/124 |
| 4,435,666 | 3/1984 | Fukui et al. | 310/323 X |
| 4,449,836 | 5/1984 | Yamada | 400/124 |

*Primary Examiner*—Paul T. Sewell

*Attorney, Agent, or Firm*—Sughrue, Mion, Zinn, Macpeak & Seas

[57] ABSTRACT

In an impact printer head intermittently movable along a printing line and comprising a plurality of printer units (25) each of which has a thickness and a printing wire (30) having a printing end operable between rest and actuated positions along a line of displacement (R), a support member (45) supports the printing wires so that a distance between two adjacent ones of the printing ends becomes smaller than each thickness at the actuated positions. To this end, the printer units are radially disposed by the supporting member to make the lines of displacement form an acute angle for two adjacent printer units and to position the printing ends in a predetermined configuration at the actuated positions. The predetermined configuration may be a single straight line perpendicular or oblique to the printing line. Alternatively, the configuration may be a pair of straight lines orthogonal or inclined to the printing line. The printing ends may be parallel to one another when supported by the support member along a straight line inclined to the printing line.

12 Claims, 20 Drawing Figures

FIG. 17
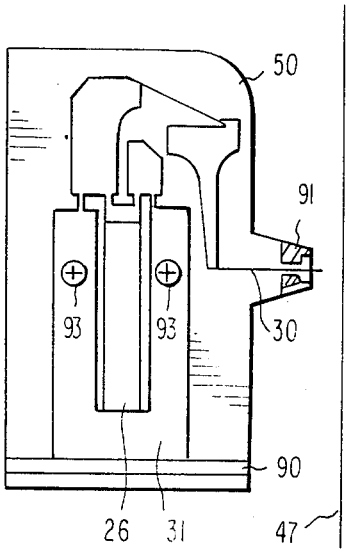
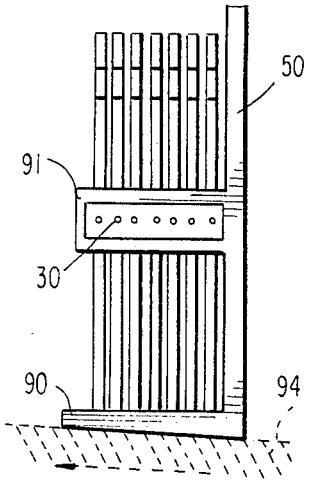
FIG. 18
FIG. 19
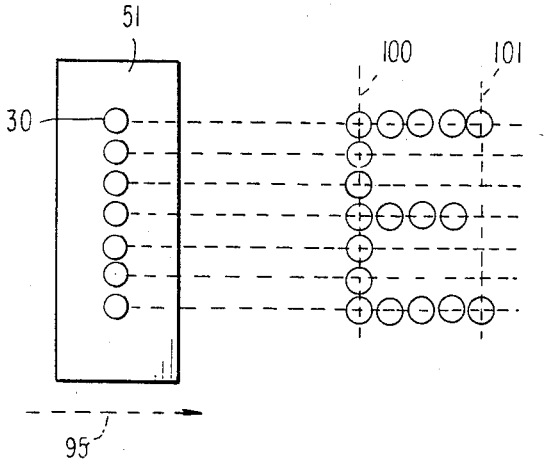
FIG 20
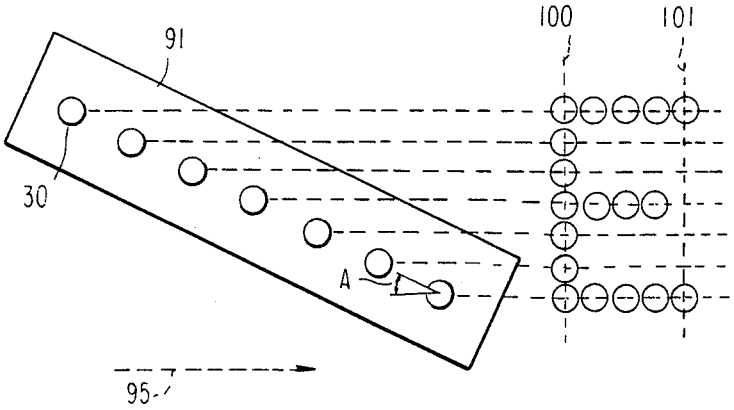

IMPACT PRINTER HEAD CAPABLE OF PRINTING A DOT AT A DISTANCE NARROWER THAN A THICKNESS OF A PRINTER UNIT

BACKGROUND OF THE INVENTION

This invention relates to an impact printer head for use in printing a dot or dots on a recording medium so that a combination of the dots may represent letters.

In the copending U.S. patent application Ser. No. 381,479 filed on May 24, 1982, by Izumu Fukui et al., a printer unit is proposed which comprises a longitudinal-effect electroexpansive transducer, a printing rod or wire, and a frame member coupled to the transducer and the printing wire for actuating the printing wire towards and away from a recording medium in compliance with expansion of the transducer to print a dot on the recording medium when the transducer is energized or expanded. The longitudinal-effect electroexpansive transducer gives rise to a large displacement as compared with a transverse-effect electroexpansive transducer. This means that the proposed printer unit can save electric power and becomes compact in comparison with a printer unit comprising the transverse-effect electroexpansive transducer.

In order to construct an impact printer head, a plurality of printer units as mentioned above are stacked in a direction of a thickness of each printer unit in parallel to one another to dispose the respective printing wires in parallel. It is mentioned here that each of the printer units is thicker in thickness than each printing wire and that a dot distance between two adjacent dots is preferably as short as possible in order to raise a density of dots in such an impact printer head. This enables a letter to be printed with a greater number of dots to make a letter appear more clearly as compared with the letter printed with a less number of dots.

Since the dot distance is dependent on the thickness of each printer unit, an attempt has been made to shorten the dot distance by rendering each thickness thin. However, each printer unit inevitably becomes weak in mechanical strength as a result of such an attempt.

Alternatively, each of the printing wires has been bent or deformed to narrow a distance between two adjacent ones of the printing wires. In this event, the printing wires become long and heavy. Accordingly, an impact printer head becomes large and bulky. It is difficult with the impact printer head to drive each printing wire at a high speed. Undesired tension or stress might be imposed on each bent printing wire when the bent printing wires are slidably supported by a guide or guides.

SUMMARY OF THE INVENTION

It is an object of this invention to provide an impact printer head which is capable of shortening a dot distance between two adjacent dots without weakening mechanical strength.

It is another object of this invention to provide an impact printer head of the type described which is compact in structure.

It is a further object of this invention to provide an impact printer head of the type described wherein each printing wire is capable of being driven at a high speed.

An impact printer head to which this invention is applicable comprises a plurality of printer units, each having a base line and a thickness along the base line and comprising an electromechanical transducer, a printing rod having a printing end, and coupling means for mechanically coupling the printing rod with the transducer so as to move the printing end between a rest and an actuated position along a line of displacement in compliance with operation of the transducer, supporting means for supporting the printer units so that the printing ends of the respective printer units are positioned coplanar in a predetermined configuration when the printing ends are moved to the actuated positions, respectively, and energizing means for selectively energizing the transducers of the printer units into operation to make the printing rod coupled to the energized transducer print a dot on a recording medium moved relative to the printer head along a printing line. The predetermined configuration is such as to make two adjacent dots printed on the recording medium along the printing line have a predetermined distance. According to this invention, the supporting means is for supporting the printer units so that the predetermined distance is smaller than the thickness.

BRIEF DESCRIPTION OF THE DRAWING

FIG. 17 shows a side view of the impact printer head illustrated in FIG. 16;

FIG. 18 shows a front view of the impact printer head illustrated in FIGS. 16 and 17;

FIG. 19 shows a view for describing operation of the impact printer head illustrated in FIGS. 2 and 3; and FIG. 20 shows a view for describing operation of the impact printer head illustrated in FIGS. 16 through 18.

DESCRIPTION OF THE PREFERRED EMBODIMENTS

Figure 1:
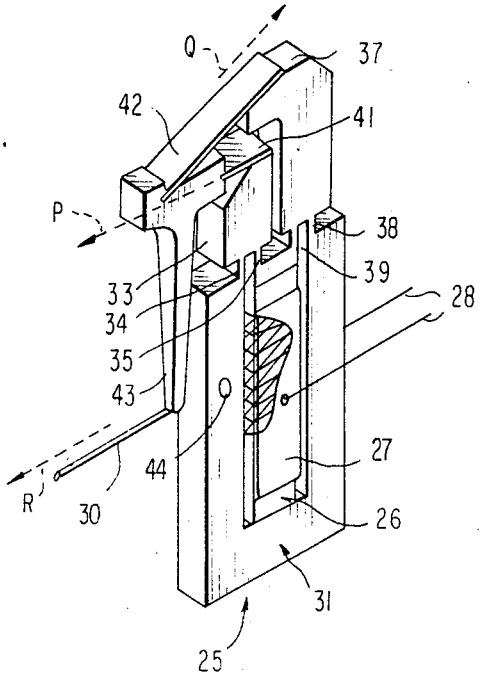
FIG. 1 shows a perspective view of a printer unit for use in an impact printer head according to a first embodiment of this invention.

Referring to FIG. 1, a printer unit 25 is applicable to an impact printer head according to a first embodiment of this invention and is equivalent to a printer unit disclosed in the above-referenced copending application. The printer unit 25 has a width in a first direction and a thickness in a second direction orthogonal to the first direction. The width and the thickness may be, for example, 15 mm and 2.0 mm, respectively.

The printer unit 25 comprises an electromechanical transducer 26 extended in a third direction orthogonal to both of the first and the second directions. The transducer 26 has a first and a second end surface extended transversely of the third direction and directed downwards and upwards of this figure, respectively. The illustrated transducer 26 exhibits a longitudinal effect and carries out operation, namely, expansion and retraction along the third direction and may be a longitudinal-effect electroexpansive transducer. In order to exhibit the longitudinal effect, the transducer 26 comprises a plurality of electroexpansive pieces each of which is interposed between a pair of internal electrodes and each of which is stacked together, as shown by a hatched portion in FIG. 1. Each of the electroexpansive pieces may be of piezoelectric ceramics, such as lead zirconate titanate, or electrostrictive ceramics, such as lead manganate niobate.

The internal electrodes are grouped into a first and a second group. More specifically, the internal electrodes of the first and the second groups are alternatingly interposed between the electroexpansive pieces. The first-group electrodes are connected in common to a first external electrode 27 attached to one side surface of the stack. Likewise, the second-group electrodes are connected in common to a second external electrode (not shown) attached to the opposite side surface of the stack. Electrical conductors 28 are connected to the first and the second external electrodes to provide an electric voltage therebetween.

The printer unit 25 comprises a printing rod or wire 30 having a printing end (not shown) and extending towards a recording medium (not shown also).

A frame member 31 mechanically couples the transducer 26 with the printing wire 30 so as to move the printing end between a rest and an actuated position along a line R of displacement in compliance with operation of the transducer 26. As will become clear as the description proceeds, the line of displacement is parallel to the first direction in the examples being illustrated.

The frame member 31 comprises a base portion having a beam portion brought into contact with the first end surface of the transducer 26 and a pair of leg portions integrally united with the beam portion. The beam portion is extended in the first direction while the leg portions are extended on both sides of the transducer 26 in the third direction. The frame member 31 comprises a first movable portion linked to the second end surface of the transducer 26 and one of the leg portions positioned in front of this figure. Likewise, a second movable portion is linked to the second end surface and the other of the leg portions positioned backward. The first movable portion comprises a first lever portion 33, a first coupling portion 34 between the first lever portion and the one leg portion, and a second coupling portion 35 between the first lever portion and the second end surface. Similarly, the second movable portion comprises a second lever portion 37, a third coupling portion 38 between the second lever portion 37 and the other leg portion, and a fourth coupling portion 39 between the second lever portion 37 and the second end surface. The first and the third coupling portions 34 and 38 are resiliently coupled to the one and the other leg portions. The second and the fourth coupling portions 35 and 39 are resiliently coupled to the second end surface on both sides thereof along the first direction, with an intermediary interposed between the second and the fourth coupling portions 35 and 39 in contact with the second end surface and made integral therewith.

When the transducer 26 is expanded by supply of the electric voltage between the first and the second external electrodes, the first and the second lever portions 33 and 37 are differentially swung forwardly and backwardly, as indicated by arrows P and Q, respectively. From this fact, it is readily understood that the first and the third coupling portions 34 and 38 provide fulcrums for the first and the second lever portions 33 and 37, respectively. At any rate, the first movable portion carries out a first movement in a first sense along the first direction in compliance with operation of the transducer 26 while the second movable portion, a second movement in a second sense along the first direction.

The first and the second movable portions are coupled to an amplifying portion. The amplifying portion differentially amplifies the first and the second movements to transmit an amplified movement to the printing wire 30. For this purpose, the amplifying portion comprises a first bridge portion 41 coupled at an end thereof to the first lever portion 33 and a second bridge portion 42 coupled at an end thereof to the second lever portion 37. An arm portion 43 which has upper and lower end portions is differentially coupled at the upper end portion to the other ends of the first and the second bridge portions 41 and 42. The printing wire 30 is connected to the lower end portion of the arm portion 43 and extended along a line of displacement indicated by an arrow R. The line of displacement is extended straight in the first direction.

The first and the second movements are differentially amplified by the arm portion 43 and transmitted as the amplified movement to the printing wire 30. The printing wire 30 can print a dot at the actuated position on the recording medium when the transducer 26 is put into operation by supply of the electric voltage to the first and the second external electrodes.

In addition, the one leg portion has a hole 44 having a hole axis in the second direction. The hole 44 is for use in determining a base line as will later be described. It may be said that the printer unit 25 has the thickness along the base line.

Figure 2:
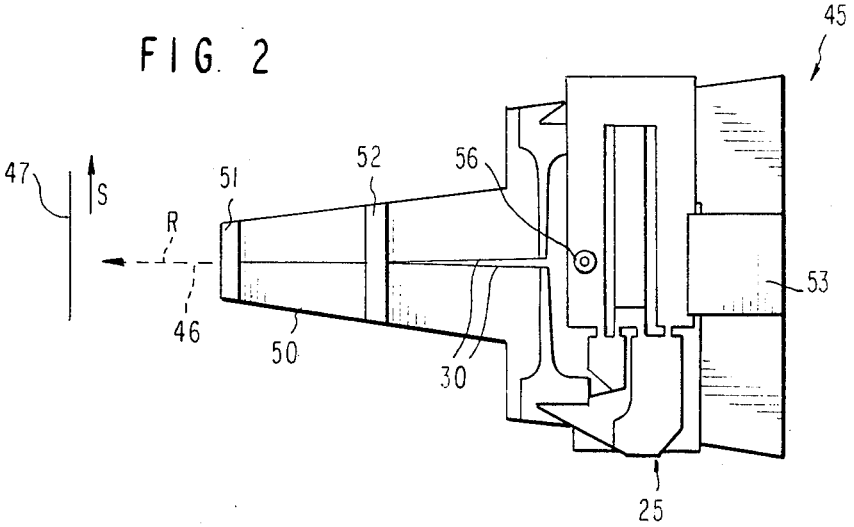
FIG. 2 shows a top view of the impact printer head according to the first embodiment of this invention.
Figure 3:
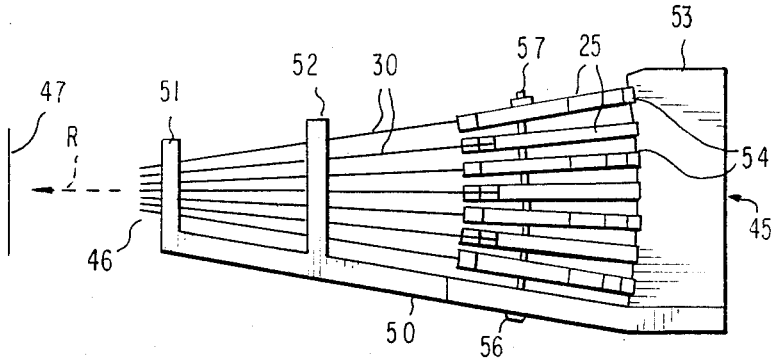
FIG. 3 shows a side view of the impact printer head illustrated in FIG. 2.

Referring to FIGS. 2 and 3, the impact printer head according to the first embodiment of this invention comprises a predetermined number of the printer units 25 of the structure illustrated in FIG. 1. The predetermined number is equal to seven in the illustrated impact printer head. The printer units 25 are supported by a support member 45 so that the printing ends (depicted at 46) of the respective printer units 25 are substantially coplanar and placed on a first straight line at the rest positions of the respective printing wires 30. Likewise, the printing ends 46 of the respective printing wires 30 are positioned coplanar on a second straight line when all of the printing ends are simultaneously moved to the actuated positions. Thus, a configuration of the illustrated printing ends 46 draws the straight line at the actuated positions.

The printer head is indexed relative to a recording medium along a printing line (indicated by an arrow S) so as to successively define parallel lines transversely of the printing line. The second straight line is parallel to the parallel line. The configuration of the printing ends 46 serves to determine a dot distance between two adjacent dots printed on the recording medium 47 at the actuated positions.

The support member 45 is for supporting the printer units 25 with the lines R of displacement made to form an acute angle for two adjacent ones of the printer units 25. More particularly, the support member 45 comprises a base plate 50 laid between two ends thereof, a first guide 51 standing on one end of the base plate 50, a second guide 52 standing intermediate between both ends of the base plate 50, and a support stand 53 fixed to the other end of the base plate 50. The base plate 50 is laid along the first direction of each printer unit 25. As shown in FIG. 3, each of the printer units 25 is radially stacked above the base portion 50 along the base line of each printer unit 25 with a spacing left between two adjacent ones of the printer units 25. For this purpose, the support stand 53 has an inside arcuate surface which is directed towards the second guide 52 and on which grooves 54 are formed to radially position the printer units 25, respectively. An arcuate bolt 56 stands on the base plate 50 along the base lines of the respective printer units 25 between the support stand 53 and the second guide 52. The bolt 56 extends through the holes 44 of each printer unit 25 and receives a nut 57 at an end thereof to support the printer units 25.

Thus, the base lines of the respective printer units 25 are placed substantially on an arc. As a result, the lines of displacement of the respective printer units 25 are disposed on a plane defined by the arc.

Each of the printing wires 30 is extended towards the second guide 52 along the second direction of each printer unit 25. The second guide 52 has a plurality of guide holes, seven in number, and disposed in parallel. The printing wires 30 are slidably extended through each guide hole of the second guide 52 and further through each guide hole disposed on the first guide 51. A distance between two adjacent ones of the guide holes of the first guide 51 is shorter than that between two adjacent guide holes of the second guide 52. It is to be noted here that each of the printing wires 30 is extended through the first and the second guides 51 and 52 without being bent or deformed. This means that undesired tension or stress is not given to each printing wire 30 and that each printing wire 30 can be displaced at a high speed.

With this structure, it is possible to render the dot distance between two adjacent dots printed on the recording medium 47 narrower or smaller than that thickness of each printer unit 25 which is described in conjunction with FIG. 1. This is because the printer units 25 are radially arranged relative to one another. Practically, the dot distance may be equal to 0.4 mm. Therefore, a density of dots can be raised in the illustrated printer head.

As best shown in FIG. 2, the printer units 25 are alternatingly directed downwards and upwards with the printing wires 30 extended in the first direction of each printer unit 25. All of the respective units 25 may however be directed upwards or downwards.

The first and the second guides 51 and 52 and the support stand 53 may be made integral with the base plate 50. In this event, the support member 45 may be made of metal or plastics. Each of the printer units 25 may be stacked with a spacer interposed between two adjacent printer units. The second guide 52 may be omitted from the above-mentioned structure, if it is possible to avoid undesired vibration resulting from the displacement of each printing wire 30.

Figure 4:
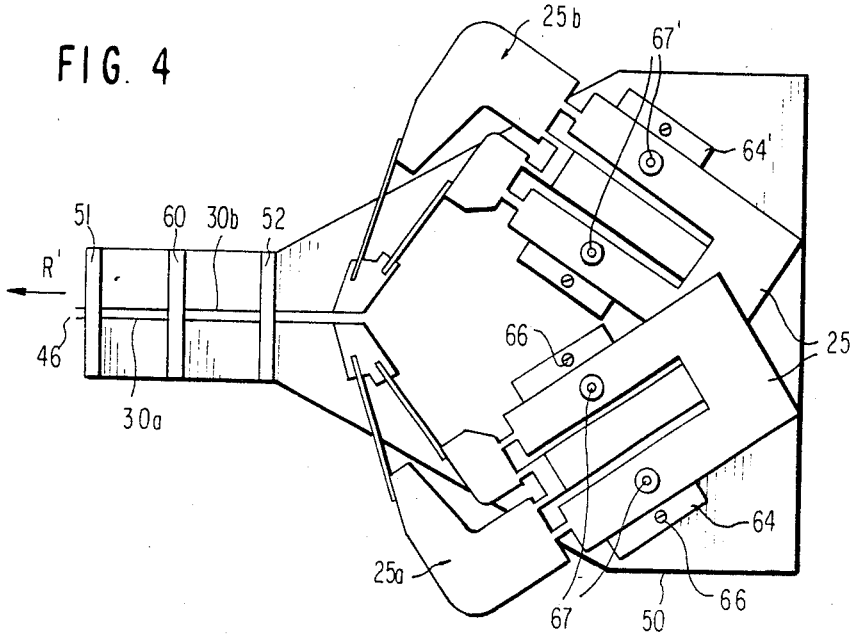
FIG. 4 shows a top view of an impact printer head according to a second embodiment of this invention.
Figure 5:
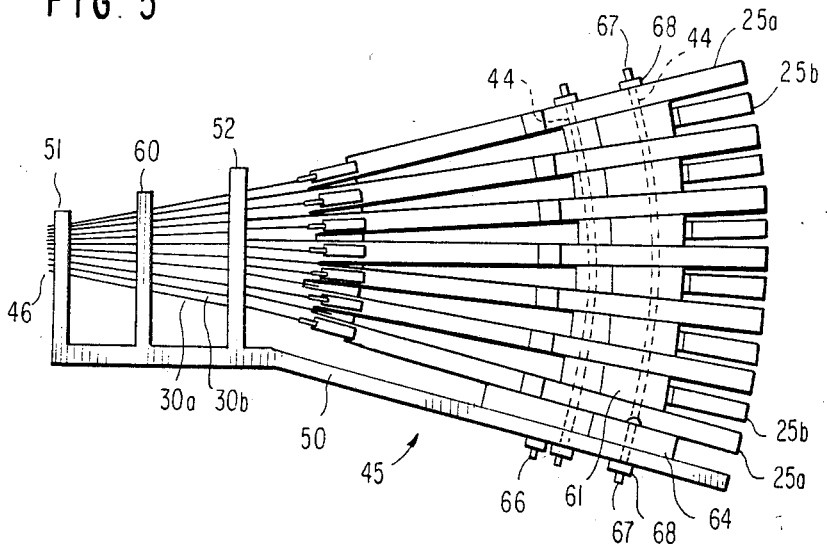
FIG. 5 shows a side view of the impact printer head illustrated in FIG. 4.

Referring to FIGS. 4 and 5, an impact printer head according to a second embodiment of this invention comprises a plurality of printer units 25 each of which is similar to that illustrated in FIG. 1 except that a line of displacement (depicted at R′) is transverse to that first direction of each printer unit 25 which defines a direction of a width, as described in conjunction with FIG. 1. A pair of holes 44 (FIG. 5) are formed on both leg portions of each frame member. Each hole 44 has a hole axis defining the base line. Each printer unit 25 has a thickness along the base line in the second direction, as described before.

The impact printer head comprises a support member 45 as is the case with the printer head illustrated in FIGS. 2 and 3. The support member 45 comprises a base plate 50 and first and second guides 51 and 52, like in FIGS. 2 and 3. A third guide 60 stands on the base plate 50 between the first and the second guides 51 and 52. The support member 45 does not comprise the support stand 53 illustrated in FIGS. 2 and 3.

The illustrated printer units 25 are thirteen in number and divided into first and second groups **25*a* and 25*b*. As shown in FIG. 5, the first group 25*a* consists of seven printer units while the second group 25*b* consists of six printer units. The printer units 25 of the first group 25*a* are radially stacked together along the base line in the second direction with a spacer 61 interposed between two adjacent ones of the printer units 25. Likewise, the printer units 25 of the second group 25*b*** are also radially stacked together.

The first group **25*a* rests on a support spacer 64 fixed to the base plate 50 by the use of a pair of screws 66 and is fastened to the base plate 50 by arcuate bolts 67 inserted into the respective holes 44 and nuts 68 fitted to both ends of each bolt 67. The second group 25*b* is also fastened to the base plate 50 by the use of a support spacer 64′ and bolts 67′ in the abovementioned manner. However, it is to be noted here that the support spacer 64′ for the second group 25*b* is higher than the support spacer 64 for the first group 25*a*. Therefore, each printer unit 25 of the second group 25*b* is positioned between two adjacent printer units of the first group 25*a*, as shown in FIG. 5, and can partially be superposed on each printer unit 25 of the first group 25*a*, as seen in FIG. 4. As a result, each printer unit 25 of the second group 25*b* alternates with each printer unit 25 of the first group 25*a*** along the base lines of the respective printer units.

As readily understood from the above, the spacers 61, the support spacers 64, 64′, the screws 66, the bolts 67, 67′, and the nuts 68 serve as a part of the support member 45.

The printer units 25 of the first and the second groups **25*a* and 25*b* comprise the printing wires depicted at 30*a* and 30*b*, respectively. Each of the printing wires 30*a* and 30*b* is extended towards a recording medium along each line R of displacement. For convenience of description, let a median plane be considered between the printing wires 30***a* and 30*b*. In FIG. 4, the printing wires 30*a* are extended parallel to the median plane on one side thereof while the printing wires 30*b*, parallel to the median plane on the other side thereof.

Inasmuch as each printer unit 25 of the first group 25*a* alternates with each printer unit 25 of the second group 25*b* in the second direction, the printing wires 30*a* are staggered relative to the printing wires 30*b* along the median plane. The printing wires 30*a* and 30*b* are extended successively through the second, the third, and the first guides 52, 63, and 51. In order to allow both of the printing wires 30*a* and 30*b* to pass through, each guide has two rows of guide holes which are disposed in parallel to the median plane and which are staggered relative to each other.

As mentioned before, the printer units of the first and the second groups 25*a* and 25*b* are radially arranged on the base plate 50, respectively. Such a radial arrangement makes the lines of displacement form an acute angle for two adjacent ones of the printing wires 30, as shown in FIG. 5.

The printing ends 46 of the respective printing wires 30 are substantially coplanar and moved between rest and actuated positions along the lines R′ of displacement, respectively, as are the cases with those illustrated in FIGS. 2 and 3.

Figure 6:
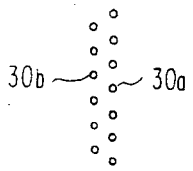
FIG. 6 shows a view for describing an arrangement of printing ends illustrated in FIGS. 5 and 6.

Temporarily referring to FIG. 6, the printing ends 46 of the respective printing wires 30*a* and 30*b* provide a configuration which serves to print dots on a recording medium at the actuated positions of the respective printing ends. In FIG. 6, the configuration has first and second straight lines which are placed in parallel on the righthand and the lefthand sides of FIG. 6, respectively, and along which the printing wires 30*a* and 30*b* are disposed, respectively. The first line is spaced apart from the second line at a line distance. The configuration determines a dot distance between two adjacent ones of the dots printed on the recording medium along each of the first and the second straight lines. The dot and the line distances may be 0.4 mm and 0.3 mm, respectively.

As illustrated in FIG. 6, the printing wires 30*a* are staggered relative to the printing wires 30*b*. The staggered arrangement of the printing wires 30*a* and 30*b* is effective to raise a density of the dots printed on the recording medium by the respective printing wires.

Either the first group 25*a* or the second group 25*b* may solely be used to form an impact printer head.

Figure 7:
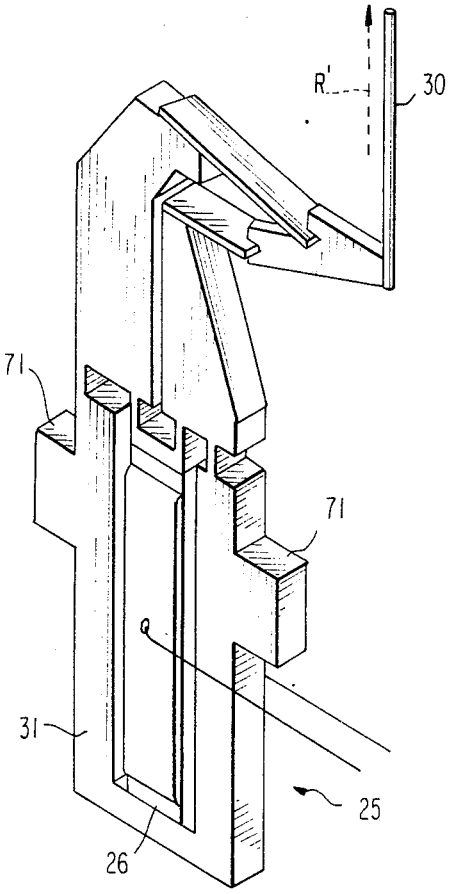
FIG. 7 shows a perspective view of a printer unit for use in an impact printer head according to a third embodiment of this invention.

Referring to FIG. 7, a printer unit 25 which can make use of an impact printer head according to a third embodiment of this invention is similar to that illustrated in FIGS. 5 and 6 except that a pair of protrusions 71 projected from the leg portions of the frame member 31 in the first direction of the printer unit 25. Each protrusion 71 has an upper and a lower surface upwards and downwards of this figure and a side surface adjoining both of the upper and the lower surfaces. Upper and lower edges are defined between the upper and the side surfaces and between the side and the lower surfaces. Let the lower edge define a base line in the illustrated printer unit 25. The printer unit 25 has a thickness along the base line and a width transversely of the base line.

Figure 8:
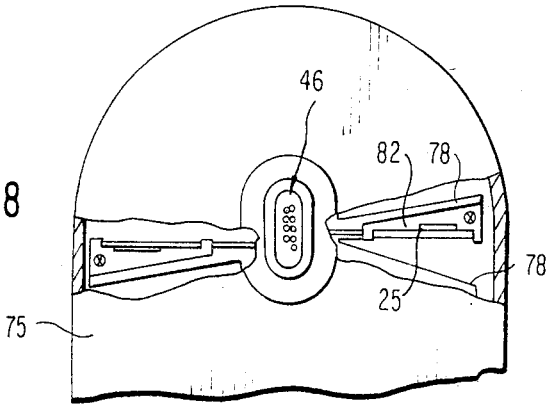
FIG. 8 shows a top view of the impact printer head according to the third embodiment of this invention with a part cut away.
Figure 9:
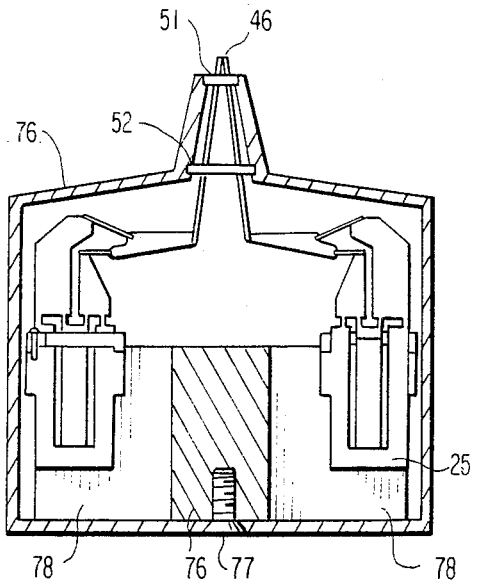
FIG. 9 shows an axial sectional view of the impact printer head illustrated in FIG. 8.

Referring to FIGS. 8 and 9, the impact printer head according to the third embodiment of this invention is similar to that illustrated with reference to FIGS. 4, 5, and 6 except that the printer units 25 illustrated in FIG. 7 are set upright, with spacings azimuthally left between two adjacent ones of the printing units 25. In other words, the illustrated printer units 25 are radially arranged along the base line of each printer unit 25. Like in FIG. 7, the printing ends 46 of the respective printing wires 30 are positioned in a configuration having a first and a second straight line along a median plane therebetween, as shown in FIG. 8. The printing ends placed on the first line are staggered relative to those placed on the second line.

More specifically, the illustrated printer head comprises a cover 75 having a hollow space therein and a neck portion and a body portion contiguous to and wider than the neck portion. The body portion has a bottom portion, a side portion adjoining to the bottom portion, and a shoulder portion adjacent to the side portion. The printer head has a head axis extended along the median plane and perpendicular to the bottom portion.

In the hollow space, a cylindrical stud 76 is fixed to the bottom portion along the head axis by a screw 77. The stud 76 has a cylindrical surface around the head axis. A plurality of supports 78 are radially outwardly extended from the cylindrical surface with the spacing azimuthally left between two adjacent ones of the supports 78.

Figure 10:
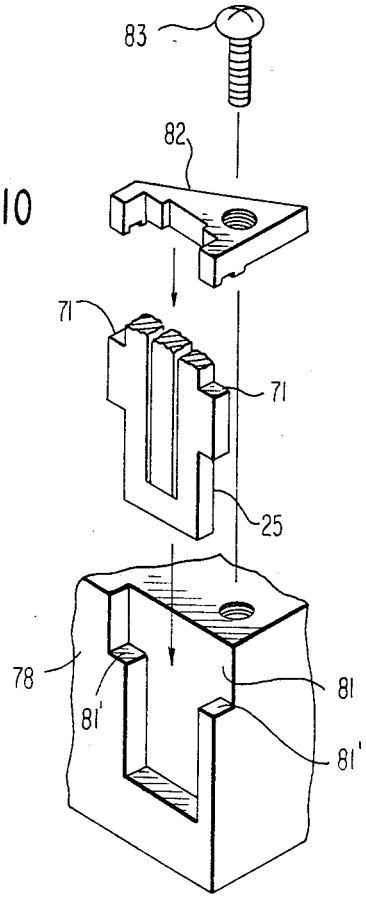
FIG. 10 shows an enlarged perspective view of a part of the impact printer head illustrated in FIGS. 8 and 9.

Referring to FIG. 10 together with FIGS. 8 and 9, each support 78 has a pocket portion 81 having a pocket width and a pocket thickness transversely of and along the base lines of the printer unit 25. The pocket width and the pocket thickness are wide and thick enough to the printer unit 25, respectively. The pocket portion 81 further has a pair of shoulders 81′. The protrusions 71 of the printer unit 25 is seated on the shoulders 81′. As readily understood from FIG. 10, each of the printer units 25 is fastened to the support 78 by interposing the protrusions 71 between the support 78 and a stopper or retainer 82 and by fixing the retainer 82 to the support 78 by a screw 83. Thus, the printer units 25 are fixed to the respective supports 78 perpendicularly to the bottom portion.

As shown in FIG. 9, the width of each printer unit 25 is radially extended from the head axis and the printing wires 30 are directed inwardly of the space. As a result, the printing wires 30 are inwardly converged towards the neck portion of the cover 76.

The respective printing wires 30 are slidably guided at the neck portion by the first and the second guides 51 and 52 to form the configuration at the printing ends, as shown in FIG. 8.

With this structure, the printing ends of the printing wires 30 are positioned coplanar in a configuration similar to that illustrated in conjunction with FIGS. 4 through 6 when the printing ends are moved to the actuated positions.

Figure 11:
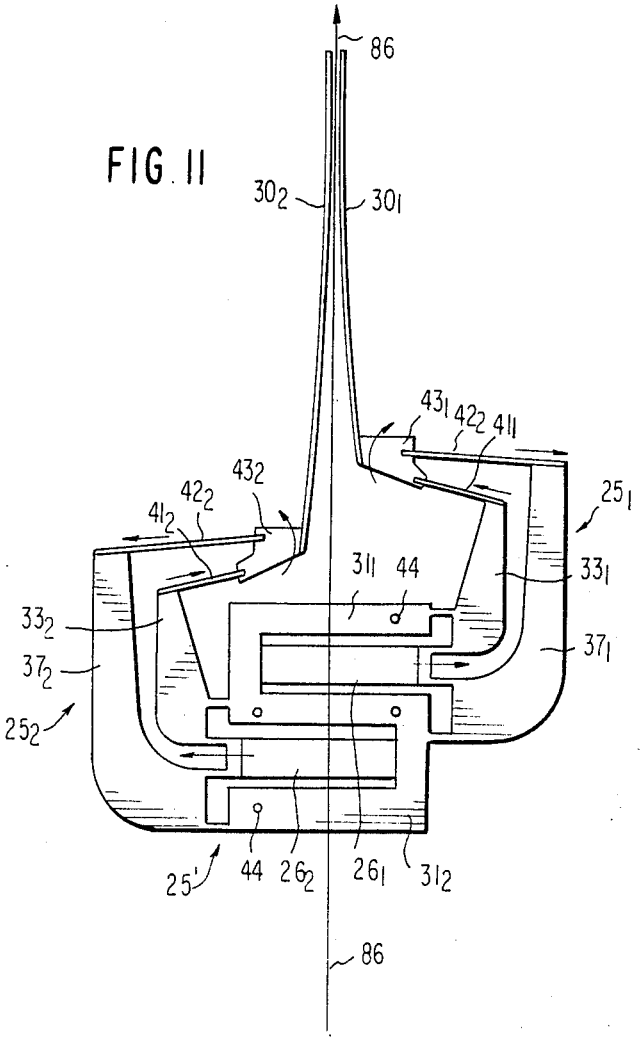
FIG. 11 shows a plan view of a printer unit for use in an impact printer head according to a fourth embodiment of this invention.

Referring to FIG. 11, a printer unit 25′ which is applicable to an impact printer head according to a fourth embodiment of this invention comprises first and second partial units $25_1$ and $25_2$ each of which is similar to the printer unit 25 illustrated in FIGS. 4 and 5. Such a printer unit 25′ may be called a twin type printer unit. Elements and portions corresponding to those of the printer unit 25 illustrated in FIGS. 4 and 5 are represented by suffixes 1 and 2 attached to like reference numerals in relation to the first and the second partial units $25_1$ and $25_2$, respectively. The frame member $31_1$ of the first partial unit $25_1$ is rendered integral with the frame member $31_2$ of the second partial unit $25_2$ into an angled S-shaped frame. With this structure, a single leg portion is common to both of the first and the second partial units $25_1$ and $25_2$. Thus, both of the frames $31_1$ and $31_2$ become coplanar as a result of combination of the first and the second partial units $25_1$ and $25_2$.

The transducers $26_1$ and $26_2$ of the first and the second partial units $25_1$ and $25_2$ are operable in opposite senses along that third direction of each partial unit which is perpendicular to the first and the second directions of each partial unit $25_1$ and $25_2$.

The illustrated printer unit has a unit axis 86 perpendicular to the third directions of the first and the second partial units $25_1$ and $25_2$. The first partial unit $25_1$ is nonsymmetrical with the second partial unit $25_2$ relative to the unit axis 86. The printing wires $30_1$ and $30_2$ are extended along the unit axis 86 on both sides thereof and, therefore, have lines of displacement along the unit axis 86. To this end, the frame members $31_1$ and $31_2$ have movable portions (depicted at $33_1$ and $37_1$, and $33_2$ and $37_2$) attached to the leg portions and extended along the unit axis on both sides thereof. The amplifying portions (depicted at $41_1$, $42_1$, and $43_1$, and $41_2$, $42_2$, and $43_2$) are directed towards the unit axis 86 from both sides thereof so as to couple the printing wires $30_1$ and $30_2$ to the movable portions, respectively. Both of the printing wires $30_1$ and $30_2$ are coplanar because the frame members $31_1$ and $31_2$ are coplanar together with the movable and the amplifying portions.

Although each of the printing wires $30_1$ and $30_2$ is transverse or oblique to the first direction of each partial unit $25_1$ and $25_2$ in this figure, each printing wire $30_1$ and $30_2$ may be parallel to the second direction, as is the case with FIG. 1.

In addition, the transducers $26_1$ and $26_2$ are individually and selectively energized by an electric power source (not shown) to put into operation the printing wires $30_1$ and $30_2$ coupled to the energized transducers.

The frame members $31_1$ and $31_2$ made integral with each other have a plurality of holes 44, each of which has a hole axis defining a base line. The base line is extended in the second direction and orthogonal to the unit axis 86. The illustrated twin type printer unit has, in the first direction, a width narrower than twice the width of the printer unit illustrated in FIGS. 4 and 5.

Figure 12:
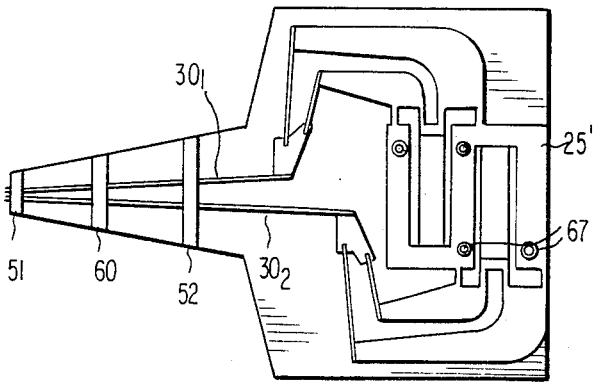
FIG. 12 shows a top view of the impact printer head according to the fourth embodiment of this invention.
Figure 13:
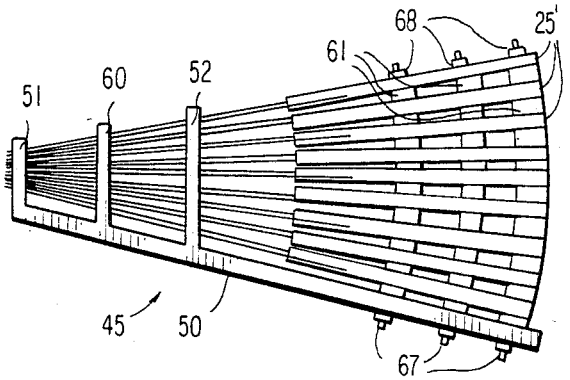
FIG. 13 shows a side view of the impact printer head illustrated in FIG. 12.

Referring to FIGS. 12 and 13, the impact printer head according to the fourth embodiment of this invention is similar to that illustrated in FIGS. 4 and 5 except that the twin type printer unit 25' illustrated in FIG. 11 is used instead of the printer unit 25 illustrated in FIGS. 4 and 5 and that each of the first through the third guides 51, 52, and 60 has guide holes which are not staggered relative to each other along two parallel lines because each pair of the printing wires $30_1$ and $30_2$ is coplanar.

As shown in FIG. 13, the twin type printer units 25' are radially stacked together along the base line, namely, in the direction of each thickness. For this purpose, the support member 45 comprises three of spacers 61 between two adjacent ones of the twin type printer units 25' in addition to the first through the third guides 51, 52, and 60 and to the base plate 50. Arcuate bolts 67 are extended through the respective printer units 25' and the spacers 61 to be fastened to the base plate 50 and the outermost one of the printing units 25' by nuts 68.

Figure 14:
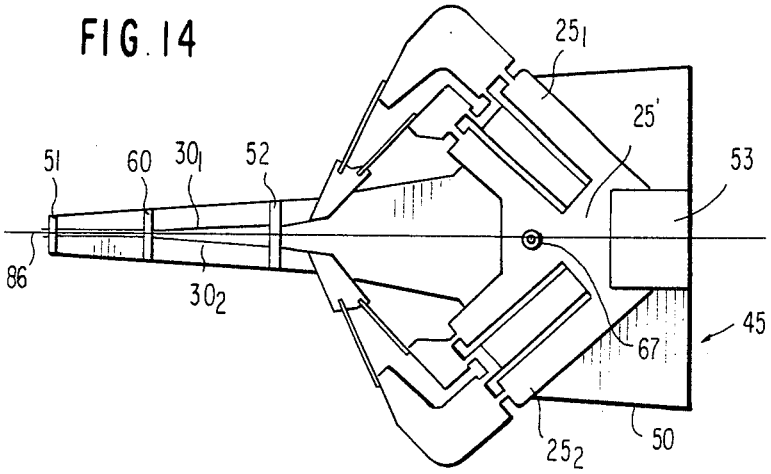
FIG. 14 shows a top view of an impact printer head according to a fifth embodiment of this invention.
Figure 15:
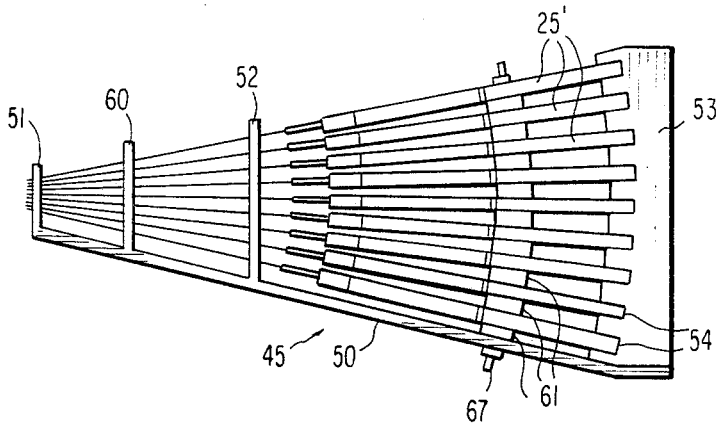
FIG. 15 shows a side view of the impact printer head illustrated in FIG. 14.

Referring to FIGS. 14 and 15, an impact printer head according to a fifth embodiment of this invention comprises a plurality of twin type printer units 25' each of which is similar to that illustrated in FIG. 11 except that first and second partial units $25_1$ and $25_2$ are made integral with each other so that both partial units $25_1$ and $25_2$ are symmetrical to each other relative to a unit axis 86. Each of the first and the second partial units $25_1$ and $25_2$ has the leg portions oblique to the unit axis 86 at the same angle, such as 45°. Each of the amplifying members depicted at $41_1$, $42_1$, and $43_1$ and $41_2$, $42_2$, and $43_2$ is directed towards the unit axis 86 on both sides thereof.

The respective printer units 25' are radially fixed to the support member 50 relative to each other, with a space left between two adjacent ones of the printing units 25'. The support member 45 comprises a base plate 50, first through third guides 51, 52, and 60, spacers 61 placed between pairs of two adjacent printer units 25', and an arcuate bolt 67 extended through the printer units 25', the spacers 61, and the base plate 50. The support member 45 further comprises a support stand 53 similar to that illustrated in FIGS. 2 and 3. The support stand 53 has an inside arcuate surface having a plurality of grooves 54. Each of the printer units 25' is inserted into each groove 54 to be fixed thereto.

Figure 16:
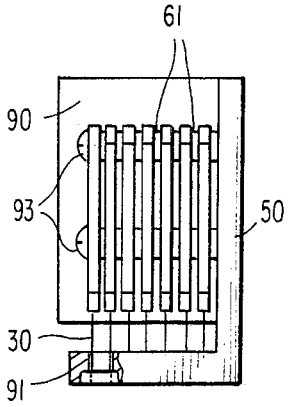
FIG. 16 shows a top view of an impact printer head according to a sixth embodiment of this invention with a part cut away.

Referring to FIGS. 16, 17, and 18, an impact printer head according to a sixth embodiment of this invention comprises a plurality of printer units 25 each of which is similar to that illustrated in FIG. 1. A support member 45 comprises a base plate 50 having an upper and a lower end, a mounting portion 90 contiguous to the lower end of the base plate 50, and a guide 91 intermediate between the upper and the lower ends of the base plate 50.

More particularly, the printer units 25 are stacked together on the base plate with spacers 61 interposed between two adjacent ones of the printer units 25. Each of the printer units 25 is fixed to the base plate 50 together with the spacers 61 by the use of a pair of screws 93. With this structure, the printer units 25 are kept substantially parallel to one another on the base portion 50. Each of the screws 93 is extended along a base line of each printer unit 25. Each printer unit 25 has a thickness along the base line. Thus, the printing ends of the respective printing wires 30 have lines of displacement substantially parallel to one another. The guide 91 has a succession of guide holes along a straight line perpendicular to the base plate 50. Each of the guide holes slidably guides each printing wire 30. Each guide hole is extended along each line of displacement of the printing wires 30. Inasmuch as the printing units 25 are disposed in parallel, an end distance between two adjacent ones of the printing ends is determined by the thickness of each printer unit 25 and a thickness of each spacer 61 and is therefore wider than that illustrated in conjunction with FIG. 3.

However, it is possible with the illustrated structure to shorten a dot distance printed on a recording medium 47, as will become clear. Let the printer head be attached to a carriage 94 and be moved relative to the recordingr medium 47 along a printing line depicted by an arrow 95. It is mentioned here that the dot distance is determined by two adjacent dots printed on the recording medium 47 along the printing line 95. This means that the dot distance is specified by a configuration given by the printing ends at the actuated positions thereof. In other words, if the end distance can be shortened at the actuated positions of the printing wires 30, the dot distance can also be shortened.

It is mentioned here that the printing ends of the respective printing wires 30 are disposed along a line of disposition at the rest positions of the respective printing ends.

Under the circumstances, the line of disposition is inclined to the printing line 95, as shown in FIG. 18, and each printing wire 30 is driven to give the configuration at the actuated positions. To this end, the mounting portion 90 has a bottom surface which is attached to the carriage 94 and which forms an acute angle with the printing line 95. In addition, each printing wire 30 is driven in a time division fashion, as will later be described with reference to FIG. 20.

Referring to FIGS. 19 and 20, comparison will be made between the impact printer heads illustrated in FIGS. 1 through 3 and in FIGS. 16 through 19.

In FIG. 19, the impact printer head illustrated in FIGS. 1 through 3 is moved along the printing line 95 and is for use in printing a letter "E" from the first printing position 100 to the last printing one 101. The straight line formed by the printing ends of the printing wires 30 is substantially perpendicular to the printing line 95. The printing wires 30 are simultaneously driven at the first printing position 100 to print the dots. Thereafter, the printing wires 30 are selectively driven at the remaining printing positions.

In FIG. 20, the impact printer head illustrated in FIGS. 16 through 18 has the printing ends disposed along the straight line inclined to the printing line 95 at an acute angle A. With this structure, tanA is about $\frac{1}{2}$. When such an impact printer head is used to print the letter "E" between the first and the last printing positions 100 and 101, each printing wire is successively driven at the first printing position 100 each time when reaches the first printing position 100. As a result, the printing wires 30 are successively actuated from the lowest one of the printing wires 30 to the highest one at the first printing position. Similar operation is carried out at the remaining printing positions. Thus, it is possible to accomplish a density of dots which is substantially equal to that of the printer head illustrated in FIGS. 1 through 3.

It is readily possible to drive the printing wires 30 in the above-mentioned time divisional fashion by the use of a well-known technique. For example, electric voltages may be supplied to the transducers through delay circuits having delay times different from one another. The delay times may be determined in consideration of the acute angle, the distance between two adjacent ones of the printing wires 30, and the dot distance to be printed on the printing medium.

In the above description, the word "electroexpensive" should be understood to include the notion of "electrocompressive."

While this invention has thus far been described in conjunction with several embodiments thereof, it will readily be possible for those skilled in the art to put this invention into practice in various manners. For example, each of the printer head illustrated in FIGS. 2 and 3; FIGS. 8 and 9; FIGS. 12 and 13; and FIGS. 14 and 15 may have the printing ends along a straight line or lines oblique to the printing line.

What is claimed is:

1. An impact printer head comprising:

a plurality of printer units, each having a base line defining a thickness and a width perpendicularly of said thickness and comprising a longitudinal-effect electroexpansive transducer, a printing rod having a printer end, and coupling means for mechanically coupling said printing rod with said transducer so as to move said printing end between a rest and an actuated position along a line of displacement in compliance with operation of said transducer;

supporting means for supporting said printer units along the base lines thereof so that the printing ends of the respective printer units are positioned coplanar in a predetermined configuration when said printing ends are moved to the actuated positions, respectively; and energizing means for selectively energizing the transducers of said printer units into operation to make the printing rod coupled to the energized transducer print a dot on a recording medium moved relative to said printer head along a printer line, said predetermined configuration being such as to make two adjacent dots printed on said recording medium transversely of said printing line have a predetermined distance smaller than said thickness;

wherein said supporting means comprises:

a base plate defining a support surface; and an arcuate bolt which is extended through the respective printer units along the base lines thereof to said base plate and which is fastened to said base plate with an acute angle formed between each adjacent pair of said printing rods so that said predetermined distance is smaller than said thickness.

2. An impact printer head as claimed in claim 1, wherein said supporting means is for supporting said printer units with the lines of displacement made to form an acute angle for two adjacent ones of said printer units.

3. An impact printer head as claimed in claim 2, wherein said predetermined configuration is a straight line.

4. An impact printer head as claimed in claim 3, wherein said straight line is perpendicular to said printing line.

5. An impact printer head as claimed in claim 3, said printing ends being disposed along a line of disposition at the rest positions, wherein said supporting means is for supporting said printer units with an acute angle formed between said printing line and said line of disposition at the rest positions to provide said straight line at the actuated positions.

6. An impact printer head as claimed in claim 5, wherein tanA is equal to $\frac{1}{2}$ where A represents the acute angle formed between said line of disposition and said printing line.

7. An impact printer head as claimed in claim 1, said printing ends being disposed along a line of disposition at the rest positions, wherein said supporting means is for supporting said printer units with the lines of displacement disposed in parallel and with an acute angle formed between said printing line and said line of disposition at the rest position to provide said predetermined configuration at the actuated positions.

8. An impact printer head as claimed in claim 2, wherein said predetermined configuration is a first and a second straight line which are parallel to each other.

9. An impact printer head as claimed in claim 8, wherein the printing ends on said first straight line are staggered relative to those on said second straight line.

10. An impact printer head as claimed in claim 1, said transducer having first and second end surfaces opposite to each other and a pair of side surfaces extended between said first and said second end surfaces, wherein each of said coupling means comprises:

a beam portion having a beam surface attached to said first end surface;

a pair of leg portions united with said beam portion and extended on both sides of said transducer along said side surface, respectively;

a first movable portion linked to said second end surface and one of said leg portions for making a first movement in a first sense along the line of displacement in compliance with operation of said transducer;

a second movable portion linked to said second end surface and the other of said leg portions for making a second movement along the line of displacement in a second sense opposite to said first sense in compliance with operation of said transducer; and an amplifying portion coupled to said first and said second movable portions and said printing rod for differentially amplifying said first and said second movements to transmit an amplified movement to said printing rod and, thereby, to displace said printing end by said amplified movement along the line of displacement.

11. An impact printer head as claimed in claim 1, wherein the line of displacement is extended along a direction of said width.

12. An impact printer head as claimed in claim 1, wherein the line of displacement is transverse to a direction of said width.

* * * * *